United States Patent [19]

Rump et al.

[11] 4,093,416

[45] June 6, 1978

[54] PROCESS FOR PRINTING CARPETS

[75] Inventors: Björn Sigurd Rump, Geneva, Switzerland; Philippe Jean Dereux, St-Julien-en-Genevois, France

[73] Assignee: Ciba-Geigy AG, Basel, Switzerland

[21] Appl. No.: 646,026

[22] Filed: Jan. 2, 1976

[51] Int. Cl.[2] ..... D06P 1/20; D06P 3/04; D06P 7/00

[52] U.S. Cl. ..... 8/2.5 A; 8/1 XB; 8/39 B; 8/39 C; 8/62; 8/176

[58] Field of Search ..... 8/1 XB, 2.5 A, 39 B, 8/39 C, 62, 176

[56] References Cited

U.S. PATENT DOCUMENTS

| | | | |
|---|---|---|---|
| 3,829,286 | 8/1974 | Anzai et al. | 8/2.5 A |
| 3,893,801 | 7/1975 | Vellins et al. | 8/2.5 A |

OTHER PUBLICATIONS

ICI Fibers Manual, "Transfer Printing of Crimplene", Edition 1, 11/71.

Textile World, Transfer Printers Success, pp. 55–57, 1/74.

Papers of the American Association for Textile Technology Inc. Tufting Technology, pp. 101–103, 5/67.

Continuous Dyeing for Synthetic Carpet Fibers, T. L. Dawson, 7/30/69, pp. 336/17–344/25.

*Primary Examiner*—John Kight, III

*Attorney, Agent, or Firm*—Wenderoth, Lind & Ponack

[57] ABSTRACT

Dry heat-transfer process in which the vapor transfer of the dyestuff or dyestuffs is not carried out onto the partly finished textile material, but onto the web or warp of yarns before they enter the machine where the yarns will be, for example, weaved, knitted or assembled and attached to a base to form a carpet, said process being characterized in that, after transfer, the yarns are not separated, to be wound up separately, from the strip of transfer paper, but on the contrary the paper strip and the yarns are wound up together on a beam, and transfer-paper to be used according to said process.

17 Claims, No Drawings

PROCESS FOR PRINTING CARPETS

It is well known that it is possible to print by the dry heat-transfer process carpets made of synthetic fibres (namely polyamides and polyesters) by transferring in vacuum the dyestuffs of the temporary support when they have been previously deposited onto the web of yarns which form the carpet. It is the subject of German application No. DOS 2,360,881. The Swiss application No. 14341/74 (Swiss Pat. No. 580,198) relates to a similar process which does away with the need for vacuum.

The later invention relates to a process for a dry heat-transfer printing in the vapor state of carpets, characterised in that the dry transfer of the dyestuff or dyestuffs is not carried out onto the carpet at a part-finished or even finished stage, but onto the web of yarns which will form the pile or the loops, before they enter the machine where these yarns will be assembled and attached to a base to form the carpet, and that to do this disperse dyestuffs having good penetration are used.

In these processes, webs of yarns are printed, and once they have been printed (or dyed) the yarns are, as in the conventional processes, introduced into the machine where the carpet forms, for example in a "tufting" machine which functions somewhat on the principle of a sewing machine (successive loops are in this case formed by "sewing" the yarns, by means of a needle, into a base which is generally a jute or polypropylene woven fabric). It is also possible to use as carpet forming machine a toothed double wheel, as in the process of German Pat. No. 1,002,724, or a more complicated device such as those of the Radcliffe processes, or of the Bigelow-Sandford process (compare U.S. Pat. No. 2,638,960), or of the Debron Couquet process.

To avoid a build-up (or a breakage of the yarns) between the calender and the machine where the carpet forms, synchronisation is necessary. This synchronisation can be achieved by various means; for example, it is possible to adjust the speed of the heat-transfer printing calender to that of the "tufting" machine. It is also possible to insert, between these two, an accumulator of a known type, such as for example a series of beams on which the yarns coming from the calender are wound up; thereafter, each beam is unwound at a speed corresponding to that of the tufting machine.

The process is effective; however, some difficulties may arise during the unwinding of the yarn beam when the tension of the yarn causes the latter to slip inside the mass of the wound up years.

One of the aims of the present invention is to avoid such a disadvantage. Further consequences follow as a natural course. The present invention relates to a dry heat transfer printing in gas phase, by which heat is used for the transfer of the dyestuff or dyestuffs onto the web of yarns which later enter a machine where they will be assembled and attached to a base to form the carpet. The process is characterised in that after transfer has taken place, the yarns are not separated from the strip of paper used as temporary support for the dyestuffs, but on the contrary are wound up together and separated only as the yarns enter the machine where they will be assembled and attached to a base to form the carpet.

The present process is only applicable to carpets or moquette-like products of which the piles or loops consist (or contain a major proportion) of fibres which lend themselves to the heat-transfer printing process, such as, for example, the fibres to be found in synthetic textiles, principally those of polyamide, such as polyamides 6 and 6,6, but also those of polyacrylonitrile and of linear polyesters such as polymers of ethylene terephthalate.

To obtain a carpet of which the piles (or the loops) are dyed uniformly, it is preferable to carry out the present process of a web of yarns of low thickness, the ideal thickness being that of a web of which all the yarns are arranged in parallel configuration alongside one another, and which only comprises one layer of yarns. The heat-transfer printing of these yarns is carried out by causing them to come into contact with a temporary support carrying the necessary dyestuff or dyestuffs, on one or more internally or externally heated drums. If the drum is heated externally, the temporary support, generally of paper, compresses the yarns onto the drum, thus ensuring pressure and good contact. In the converse case, the temporary support is inserted between the drum and the web of yarns, the contact being ensured by the longitudinal tension of the yarns or by a blanket.

However, since the penetrating dyestuffs which can be used in the present invention soil the blanket, it is advisable to operate on a device where the web of yarns is laid on the calender only by the tension of the yarns themselves.

It is also possible to pass a web of yarns, inserted between temporary supports carrying the dyestuffs to be transferred, over an internally or externally heated drum (calender).

In order to avoid too much alteration of the structure and texture of the yarns through their passage on the heat-transfer printing calender, it is advisable to insert before the latter, a number of pulleys rotating at a slightly higher speed than that of the calender, the result being a lowering of the tension of the yarns and a restoring of their texture.

The transfer takes place simply, as in the ordinary heat-transfer printing process, by heating. Obviously the material is heated to temperatures below those at which the fibres decompose or undergo considerable change; thus, in the case of polyamides, the yarns will be heated to less than 240° C, and preferably even to below 225° C, but not below 150° C, because below 150° C the transfer time is much too long. The most advantageous temperature range for polyamide or polyester fibres is between 180° and 205° C. The period of heating can vary considerably depending on the chosen temperature. Between 180° and 205° C it can vary between 15 and 180 seconds or even more.

The contact time, and hence the heating, on the drum obviously depends on the speed of rotation and on the diameter of the drum. However, the period of heating can be reduced, and hence higher speeds can be used, if the web of yarns is preheated, for example to 150°-200° C.

The printing of the webs of yarns may be carried out such that the distance between two yarns is smaller than in the final carpet.

The printing can be conducted without setting any difference of pressure between the two sides of the web of yarns.

The temporary supports which are used in the present process can be in the form of an endless belt or more generally a strip of printed paper. The temporary supports can be prepared like the temporary supports for heat-transfer printing, such as is described in French Pat. Nos. 1 223 330, 1 575 069 and 71.01347 (French Patent publication No. 2,076,149), with the difference that it is not the dyestuffs indicated in these patents which are used, but disperse dyestuffs of good penetration.

The expression "dyestuffs of good penetration" covers sublimable dyestuffs which can transfer through more than four layers of material, when the transfer takes place at 204° C, for 120 seconds, on polyester cloth with a weight of 60 g per square meter, and about 45 threads per cm each way, or on a satin-filament of polyamide 6,6 fixed and bleached, with a weight of 58 g per square meter and about 77 threads one way and 56 the other way per cm.

Since it may be necessary to join parts together following a possible breakage of yarn in the tufting machine, it is possible to print strips of each of the colours of the design on the edge of the temporary supports. This will unable the manipulators of the carpet making machine to use threads of the right colour for any necessary repair.

As dyestuffs which penetrate well and which therefore print the yarn throughout its thickness there may for example be mentioned, the blues of the formula:

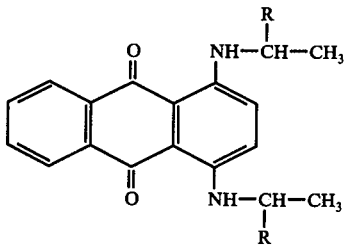

in which R denotes a hydrogen atom or a $-CH_3$ radical, the reds such as 1,5-di-isopropylaminoanthraquinone, 1-amino-2-chloro-4-hydroxyanthraquinone or 1-amino-2-bromo-4-hydroxyanthraquinone and 1-amino-4-hydroxyanthraquinone, the orange 1-amino - 2 methylanthraquinone and the yellows of the formula:

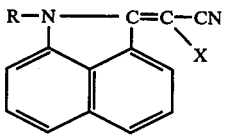

in which R denotes a hydrogen atom or an organic radical, preferably alkyl or aryl, and X denotes a carboxy-ester, aroyl, aryl, sulphonyl or nitrile radical. In order to obtain prints which are particularly wash-fast, dyestuffs which carry a chloro- or bromo-acrylyl radical or a chloro-or bromo-propionyl radical or a chloroacetyl radical will be used in the case of polyamide.

In the case of polyacrylonitrile yarns, it is possible to use temporary supports which carry cationic dyestuffs (see U.S. Pat. No. 3,969,071, DOS 2521988 and DOS 2359515) but the use of disperse dyestuffs is not excluded.

In preparing the temporary supports, account should also be taken of the longitudinal shrinkage of the pattern arising from the fact that the printed yarns are subsequently stitched in the machine, to form piles and loops.

The longitudinal shrinkage of the pattern may be lesser or greater according to the height of the latter, so that in order to obtain a given design it will be necessary to start with a paper bearing this design lengthened three, four, and even up to ten to fifteen times. Papers of such type and specially those bearing designs obtained with very penetrating dyestuffs are also the subjects of the present invention.

Once printed, the yarns which always stick to some extent to the transfer paper strip are not separated from it. It is in fact useful to use overlacquered transfer papers, the lacquer improving the adherence of the yarns, as for example those mentioned in French publication 71.01347 (French patent publication No. 2,076,149) or in the Japanese publication published on June 3rd 1974 under No. 21 602 (appl. No. 36 966 of Apr. 30th 1970).

Both yarns and paper strip are wound up on top of one another on a yarn beam and the unwinding takes place only when the yarns enter the machine where they will be assembled and attached to a base to form the carpet. Now is the time when the yarns separate most easily from the paper as they enter the machine. It was even observed that this way of proceeding insured the evenness of the design obtained. Indeed, by slowing down the unwinding of the paper strip, the yarns entering the machine undergo a weak tension os that the design obtained is clearer than when there is no tension whatever on the yarns.

To achieve certain effects, for example the lateral shrinkage or stretching of the design, and depending on whether it is desired to obtain tight carpets or looser carpets, it is possible to close up or, conversely, spread out the web of yarns as they are issuing from the calender. The present process has the advantage that it also makes it possible to obtain certain effects by longitudinally varying the dimensions of the design, by altering the height of the loops of the carpet in the tufting machine.

It is also possible to use two or three parallel colenders, which offers the advantage of being able to print webs of yarns which make it possible to produce carpets from 3 to 5 m wide without having to print papers much wider than the ordinary transfer papers (1.60 m).

Another advantage of the present process is the possibility of winding the yarns very close on one single beam in order to have enough yarns to obtain a carpet of a much greater width than that of the web of printed yarns.

In the last case, it is necessary to insert between the beam and the tufting machine a device which will set the same distance to run to all the yarns. One could use for instance, a comb-like device set along an angle profile defined by two curves, the top of which is plunging into the web or is lifting the web of yarns, preferably perpendicularly to the plane of the web, the top coinciding with the yarn coming from the middle of the beam.

We claim:

1. In a dry heat-transfer printing process for the printing of carpet yarns wherein web or warp of yarns is brought into contact with a temporary support carrying a vapor transferable dyestuff or dyestuffs and heat is applied to achieve the vapor transfer of the dyestuff or dyestuffs from the temporary support onto the web or warp of yarns, said vapor transfer being carried out prior to introducing said yarns into a machine for weaving, knitting or for attachment of the yarns to a base to form a carpet, the improvement according to which, following the vapor transfer and prior to separation of the temporary support from the yarns, the yarns and temporary support are wound onto a beam.

2. A process according to claim 1 wherein the yarns and temporary support are unwound from the beam, the yarns are separated from the temporary support and the yarns are introduced into a machine for weaving, knitting or for attachment to a base to form a carpet.

3. A process according to claim 2 wherein the speed of unwinding of the beam is controlled during the manufacture of the carpet, in order to create a tension on the yarns, when they are separated from the paper, between the beam and the carpet making machine.

4. A process according to claim 2 wherein all yarns travel an equal distance, between the beam and the machine where they are assembled and woven, knitted or attached to a base to form a carpet.

5. A process according to claim 1 wherein the temporary supports used are over-lacquered, thus insuring good adherence of it to the yarn to be printed.

6. A process according to claim 1 wherein the web of yarns is pre-heated before transfer takes place.

7. A process according to claim 2 wherein webs of yarns are printed whereby the distance between two yarns is smaller than in the finished carpet.

8. A process according to claim 1 wherein the printing takes place without setting any difference of pressure between the two sides of the web of yarns.

9. A process according to claim 5 wherein the temporary support carries a color design, over-lacquered by a thermoplastic resin.

10. A process according to claim 5 wherein the temporary support carries a color design, over-lacquered with polyvinylic alcohol.

11. A process according to claim 1 wherein the temporary support carries on at least one of its edges colored strips corresponding to each of the colors used in the design.

12. A process according to claim 1 wherein the temporary support carries a dyestuff selected from at least one of the following dyestuffs:

1-amino-2-methyl-anthraquinone,
1-amino-2-methoxy-4-hydroxyanthraquinone,
1-amino-2-chloro-4-hydroxyanthraquinone,
1-amino-2-bromo-4-hydroxyanthraquinone,
1,4-di (isopropylamino)-anthraquinone,
1,5-di(isopropylamino)-anthraquinone.

13. A process according to claim 12 wherein webs of synthetic polyamide ae printed.

14. A process according to claim 12 wherein the temporary support carries a print, said print having a design to be transferred onto the yarns which presents, lengthwise the yarns, a lengthening effect relative to the design to be obtained on the carpet.

15. A process according to claim 12 wherein the temporary support carries a print, said print having a design to be transferred onto the yarns presenting a lateral shrinking effect relative to the design to be obtained on the carpet.

16. A process according to claim 14 wherein the lengthening of the design along the length of the yarns to be printed is proportional to the height of the piles or loops of the carpet to be formed.

17. A process according to claim 14 wherein the temporary support carries along the length of the yarn a design lengthened three to fifteen times relative to the design to be obtained on the finished carpet.

* * * * *

UNITED STATES PATENT AND TRADEMARK OFFICE

CERTIFICATE OF CORRECTION

PATENT NO. : 4,093,416

DATED : June 6, 1978

INVENTOR(S) : Björn Sigurd Rump and Philippe Jean Dereaux

It is certified that error appears in the above-identified patent and that said Letters Patent are hereby corrected as shown below:

In the heading of the patent, item [73] Assignee: correct the document to read --Sublistatic Holding SA, Glaris, Switzerland--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*